US005803834A

United States Patent [19]

Yamagishi et al.

[11] Patent Number: 5,803,834

[45] Date of Patent: Sep. 8, 1998

[54] TWO-PIECE SOLID GOLF BALL

[75] Inventors: Hisashi Yamagishi; Jun Shindo, both of Chichibu, Japan

[73] Assignee: Bridgestone Sports Co., Ltd., Tokyo, Japan

[21] Appl. No.: 810,337

[22] Filed: Feb. 27, 1997

[30] Foreign Application Priority Data

Mar. 1, 1996 [JP] Japan ..... 8-071135

[51] Int. Cl.[6] ..... A63B 37/06; A63B 37/12

[52] U.S. Cl. ..... 473/377; 473/372; 473/378

[58] Field of Search ..... 473/377, 351, 473/383, 384

[56] References Cited

U.S. PATENT DOCUMENTS

| | | | |
|---|---|---|---|
| 5,403,010 | 4/1995 | Yabuki et al. | 473/377 X |
| 5,439,227 | 8/1995 | Egashira et al. | 473/377 X |
| 5,452,898 | 9/1995 | Yamagishi et al. | 473/377 |
| 5,470,075 | 11/1995 | Nesbitt et al. | 473/377 |
| 5,482,286 | 1/1996 | Molitor et al. | 473/377 X |
| 5,490,673 | 2/1996 | Hiraoka | 473/372 X |
| 5,497,996 | 3/1996 | Carlorniga | 473/377 X |
| 5,601,503 | 2/1997 | Yamagishi et al. | 473/351 X |
| 5,674,137 | 10/1997 | Maruko et al. | 473/351 X |

*Primary Examiner*—George J. Marlo
*Attorney, Agent, or Firm*—Sughrue, Mion, Zinn, Macpeak & Seas, PLLC

[57] ABSTRACT

In a two-piece solid golf ball comprising a solid core and a cover having a number of dimples, the solid core has such a distribution of hardness on a JIS-C hardness scale that a surface hardness is 70–85 degrees and a center hardness is lower than the surface hardness by 8–20 degrees, and the hardness within 5 mm inside the core surface is up to 8 degrees lower than the surface hardness. The cover has a hardness of 75–90 degrees on a JIS-C hardness scale which is higher than the surface hardness of the core by 1–15 degrees and a gage of 1.5–1.95 mm. The number of dimples is 360–450. Since the hardness distribution of the core and cover, the gage of the cover, and the number of dimples are optimized, the ball is improved in flight distance, controllability and hitting feel.

4 Claims, 2 Drawing Sheets

TWO-PIECE SOLID GOLF BALL

BACKGROUND OF THE INVENTION

1. Field of the Invention

This invention relates to a two-piece solid golf ball which is improved in flying distance, controllability, and hitting feel.

2. Prior Art

In order to manufacture golf balls of quality, numerous proposals for improving a flight distance, controllability and hitting feel have been made in the art. With respect to two-piece solid golf balls, many attempts have been made to improve performance by optimizing the hardness and hardness distribution of solid cores and covers as disclosed in JP-B 48832/1991 and 98206/1994, JP-A 109971/1992, 98949/1994, 154357/1994, 327792/1994, and 289661/1995.

Golf players always demand a golf ball which is further improved in flight distance, controllability and hitting feel. The same applies to two-piece solid golf balls.

SUMMARY OF THE INVENTION

An object of the invention is to provide a two-piece solid golf ball which is improved in flight distance, controllability and hitting feel.

According to the invention, there is provided a two-piece solid golf ball comprising a solid core and a cover enclosing the core and having a number of dimples in its surface. The solid core has such a distribution of hardness as measured by a JIS-C scale hardness meter that a surface hardness is up to 85 degrees, a center hardness is lower than the surface hardness by not less than 8 degrees to less than 20 degrees, and a hardness within 5 mm inside the core surface is up to 8 degrees lower than the surface hardness. The cover has a hardness which is higher than the surface hardness of the core by 1 to 15 degrees and a gage of 1.5 to 1.95 mm. The number of dimples is 360 to 450.

In one preferred embodiment, the solid core experiences a distortion of 2.8 to 4.0 mm under a load of 100 kg.

In a further preferred embodiment, n types of dimples are formed in the cover surface wherein $n \geqq 2$. The respective types of dimples have a diameter Dmk, a maximum depth Dpk, and a number Nk wherein k=1, 2, 3, . . . , n. An index (Dst) of overall dimple surface area given by the following expression:

$$Dst = \frac{n \sum_{k-1}^{n} [(Dmk^2 + Dpk^2) x V_0 kx Nk]}{4R^2}$$

wherein R is a ball radius and $V_0$ is the volume of a dimple space below a plane circumscribed by the edge of a dimple divided by the volume of a cylinder whose bottom is the plane and whose height is the maximum depth of the dimple from the bottom is at least 4.0. Preferably the cover has a hardness of 75 to 90 degrees as measured by a JIS-C scale hardness meter.

Investigating the flying distance, restitution, controllability, and feel of a two-piece solid golf ball, we have found the following.

When a ball undergoes a greater amount of deformation upon impact as found on driver shots, the deformation of the ball reaches a core center region. In such deformation mechanism, the cover, core surface region and core center region closely participate in deformation while the degree of participation decreases in this order. More particularly, the core surface makes a great contribution to deformation. At the same time, a difference in hardness between the core surface and the cover makes a great contribution to deformation to such an extent as to govern restitution or repulsion. A too large hardness difference leads to a larger energy loss, failing to provide sufficient restitution to travel a satisfactory distance.

If the distribution of hardness from the center to the surface through a surface-adjoining region of the core is relatively flat and at a higher level, the energy loss in the surface-adjoining region of the core mostly participating in deformation is small enough to provide restitution, but the hitting feel is hard due to the hardness near the center. Inversely, if the hardness distribution is relatively flat and at a lower level, there result a greater energy loss, insufficient restitution, and soft hitting feel. If the difference in hardness between the core surface and the cover is too large, then the hitting feel is soft, but dull at the same time.

With a focus on the surface and surface-adjoining region of the core, if the difference in hardness between the surface and the surface-adjoining region (within 5 mm from the surface) of the core is too large, the energy associated with deformation is not fully retained. This results in a greater energy loss, failing to maintain sufficient restitution.

By optimizing the hardness distribution of the core and the hardness difference between the core and the cover, we have succeeded in providing a two-piece solid golf ball which features satisfactory restitution, an acceptable flying distance, soft hitting feel, good spin properties on iron shots, and ease of control.

DESCRIPTION OF THE PREFERRED EMBODIMENTS

Figure 1:
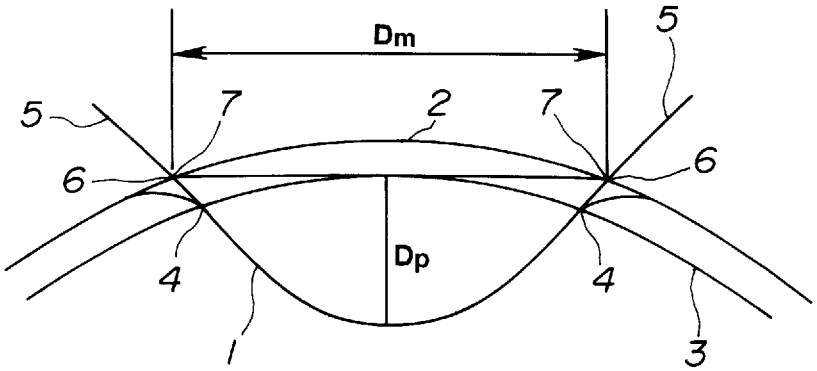
FIG. 1 is a schematic cross-sectional view of a dimple illustrating how to calculate $V_0$.

The invention pertains to a two-piece solid golf ball comprising a solid core and a cover. The 2-piece solid golf ball of the invention requires that the hardness distribution of the core be optimized. When the solid core is measured for hardness by a JIS-C scale hardness meter, the core has a hardness on its spherical surface (to be referred to as surface hardness, hereinafter), a hardness at a position located within 5 mm from the surface in a radial direction, and a hardness at the center (to be referred to as center hardness, hereinafter). The solid core should have such a distribution of hardness that the surface hardness is up to 85 degrees, preferably 70 to 83 degrees, the center hardness is lower than the surface hardness by not less than 8 to less than 20 degrees, preferably not less than 10 to less than 17 degrees, and the hardness within 5 mm inside the core surface is up to 8 degrees, preferably up to 5 degrees, lower than the surface hardness.

If the surface hardness of the core exceeds 85 degrees, the hitting feel becomes unpleasant. If the surface hardness is too low, restitution would be lost.

The center hardness is lower than the surface hardness, that is, the core center is softer than the core surface. If the hardness difference therebetween is less than 8 degrees, which means that the hardness distribution among the center, surface and surface-adjoining region of the core is relatively flat, the energy loss in the surface-adjoining region of the core mostly participating in deformation is small enough to provide restitution. However, the hitting feel is hard if the core center is hard. Inversely, if the core center is soft, the energy loss becomes too large to provide restitution and the hitting feel is soft. If the hardness difference is 20 degrees or more, restitution is lost.

While the above-mentioned hardness difference is maintained, the center hardness of the core should preferably be 50 to 75 degrees, more preferably 55 to 70 degrees on a JIS-C hardness scale for improvements in restitution, control and feel.

The hardness within 5 mm inside the core surface (that is, the hardness of a region of the core which radially extends from the surface to a depth of 5 mm in cross section) is lower than the surface hardness by 8 degrees or less, preferably by 5 degrees or less. If the hardness difference between the surface and the surface-adjoining region (within 5 mm from the surface) of the core is too large, then the energy associated with deformation is not fully retained, resulting in a greater energy loss and failure to maintain restitution.

A solid core having the above-defined hardness distribution may be formed from a conventional well-known composition comprising a base rubber, a crosslinking agent, a co-crosslinking agent, and an inert filler while vulcanizing conditions and formulation are appropriately adjusted so as to meet the requirements of the invention.

The base rubber used herein may be natural rubber and/or synthetic rubber conventionally used in solid golf balls although 1,4-polybutadiene having at least 40% of cis-structure is especially preferred in the invention. The polybutadiene may be blended with a suitable amount of natural rubber, polyisoprene rubber, styrene-butadiene rubber or the like if desired. The crosslinking agent is typically selected from organic peroxides such as dicumyl peroxide and 1,1-bis(t-butylperoxy)-3,3,5-trimethylcyclohexane. Preferred is a mixture of 1,1-bis(t-butylperoxy)-3,3,5-trimethylcyclohexane and dicumyl peroxide, especially in a blend ratio of 0.1:1 to 0.5:1. The co-crosslinking agent is typically selected from metal salts of unsaturated fatty acids, inter alia, zinc and magnesium salts of unsaturated fatty acids having 3 to 8 carbon atoms (e.g., acrylic acid and methacrylic acid) though not limited thereto. Zinc acrylate is especially preferred. The amount of the co-crosslinking agent blended is preferably about 10 to 40 parts by weight, more preferably about 20 to 30 parts by weight per 100 parts by weight of the base rubber. Examples of the inert filler include zinc oxide, barium sulfate, silica, calcium carbonate, and zinc carbonate, with zinc oxide being often used. The amount of the filler blended is preferably about 5 to 20 parts by weight, more preferably about 8 to 15 parts by weight per 100 parts by weight of the base rubber although the amount largely varies with the specific gravity of the core and cover, the weight of the ball, and other factors.

A core-forming composition is prepared by kneading the above-mentioned components in a conventional mixer such as a Banbury mixer and roll mill, and it is compression or injection molded in a core mold. The molding is then cured by heating at a sufficient temperature for the crosslinking agent and co-crosslinking agent to function (for example, at 160° C. for 20 minutes), obtaining a solid core.

A core having a desired hardness distribution can be produced by appropriately determining the formulation, especially the type and amount of crosslinking and co-crosslinking agents and vulcanizing conditions.

The solid core should preferably have a distortion of 2.8 to 4.0 mm, especially 3.0 to 3.8 mm under a load of 100 kg. Then the ball is further improved in restitution, control and hitting feel. A distortion of less than 2.8 mm would give a poor hitting feel whereas a distortion of more than 4.0 mm would fail to provide restitution.

Although the diameter, weight and specific gravity are not critical, the solid core preferably has a diameter of 37 to 41 mm, especially 38 to 41 mm and a weight of 30 to 37 grams, especially 31 to 36.5 grams.

Next, the cover enclosing the solid core should have a hardness which is higher than the surface hardness of the core by 1 to 15 degrees, preferably by 2 to 5 degrees, as measured on JIS-C hardness scale. If the difference in hardness between the core surface and the cover is less than 1 degree, the ball loses some restitution and thus travels a shorter distance. If the hardness difference is more than 15 degrees, the hitting feel becomes dull. Insofar as the hardness difference is satisfied, the cover hardness is not critical. Preferably the cover has a hardness of 75 to 90 degrees, especially 77 to 86 degrees as measured by a JIS-C scale hardness meter. A cover hardness of less than 75 degrees would lead to less restitution whereas a cover hardness of more than 90 degrees would render the hitting feel dull.

The cover has a gage (radial thickness) of 1.5 to 1.95 mm, preferably 1.55 to 1.90 mm. A cover with a gage of less than 1.5 mm would be low in cut resistance upon half-top hitting whereas a cover of more than 1.95 mm thick would lead to low restitution and dull hitting feel.

The cover satisfying such requirements may be formed of any well-known cover stock, typically based on a thermoplastic resin. Exemplary thermoplastic resins are thermoplastic urethane elastomers, ionomer resins, polyester elastomers, polyamide elastomers, propylene-butadiene copolymers, 1,2-polybutadiene, and styrene-butadiene copolymers alone or in admixture of two or more. Various additives such as barium sulfate, titanium oxide, and magnesium stearate may be added to the thermoplastic resin.

The cover may be formed by conventional methods, for example, by injection molding or compression molding a cover stock around the solid core.

Like conventional golf balls, the solid golf ball of the invention is formed with a multiplicity of dimples in the surface. The number of dimples is 360 to 450, preferably 370 to 420.

Furthermore, the golf ball of the invention wherein the number of types of dimples formed in the ball surface is n wherein n is an integer of at least 2, preferably n=2 to 6, more preferably n=3 to 5, and the respective types of dimples have a diameter Dmk, a maximum depth Dpk, and a number Nk wherein k=1, 2, 3, . . . , n prefers that an index Dst of overall dimple surface area given by the following equation is at least 4.0, more preferably at least 4.2.

$$Dst = \frac{n \sum_{k-1}^{n} [(Dmk^2 + Dpk^2) x V_0 kx Nk]}{4R^2}$$

Note that R is a ball radius, $V_0$ is the volume of a dimple space below a plane circumscribed by the edge of a dimple divided by the volume of a cylinder whose bottom is the plane and whose height is the maximum depth of the dimple from the bottom.

Figure 2:
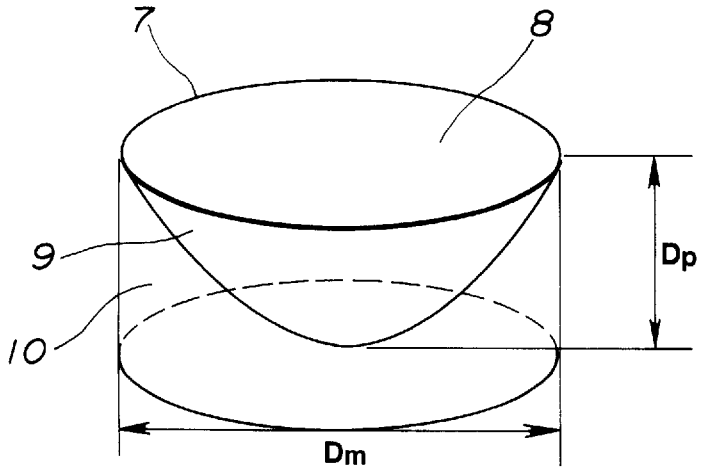
FIG. 2 is a perspective view of the same dimple.
Figure 3:
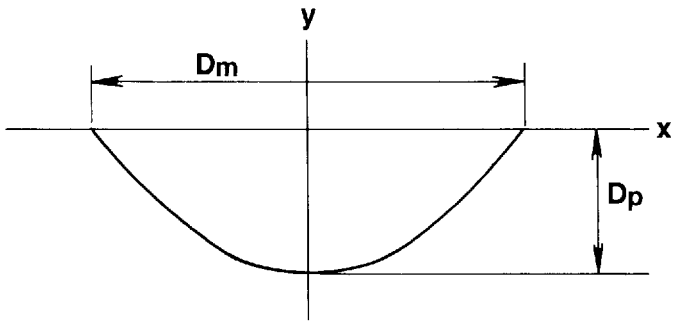
FIG. 3 is a cross-sectional view of the same dimple.

Referring to FIGS. 1 to 3, it is described how to determine $V_0$. For simplicity's sake, it is assumed that the planar shape of a dimple is circular. As shown in FIG. 1, a phantom sphere 2 having the ball diameter and another phantom sphere 3 having a diameter smaller by 0.16 mm than the ball diameter are drawn in conjunction with a dimple 1. The circumference of the other sphere 3 intersects with the dimple 1 at a point 4. A tangent 5 at intersection 4 intersects with the phantom sphere 2 at a point 6 while a series of intersections 6 define a dimple edge 7. The dimple edge 7 is so defined for the reason that otherwise, the exact position of the dimple edge cannot be determined because the actual edge of the dimple 1 is rounded. The dimple edge 7 circumscribes a plane 8 (having a diameter Dm). Then as shown in FIGS. 2 and 3, the dimple space 9 located below the plane 8 has a volume Vp. A cylinder 10 whose bottom is the plane 8 and whose height is the maximum depth Dp of the dimple from the bottom or circular plane 8 has a volume Vq. The ratio $V_0$ of the dimple space volume Vp to the cylinder volume Vq is calculated.

$$Vp = \int_0^{\frac{Dm}{2}} 2\pi xy dx$$

$$Vq = \frac{\pi Dm^2 Dp}{4}$$

$$v_0 = \frac{Vp}{Vq}$$

It is noted that the value of $V_0$ is generally 0.40 to 0.60, preferably 0.41 to 0.58 though not critical.

The two-piece solid golf ball of the invention may be produced in accordance with the Rules of Golf to a diameter of at least 42.67 mm and a weight of up to 45.93 grams.

There has been described a two-piece solid golf ball in which the hardness distribution of the core and cover, the gage of the cover, and the number of dimples are optimized to achieve improvements in flight distance, controllability and hitting feel.

EXAMPLE

Examples of the present invention are given below by way of illustration and not by way of limitation. All parts are by weight.

Examples 1–3 & Comparative Examples 1–4

By milling a solid core-forming rubber composition formulated as shown in Table 1 and vulcanizing it under conditions as shown in Table 1, there was prepared a solid core having an outer diameter, a hardness distribution and a distortion under a load of 100 kg as reported in Table 4. Note that hardness was measured by a JIS-C scale hardness meter.

Next, a cover stock formulated as shown in Table 2 was milled and injection molded over the solid core to form a cover, obtaining a 2-piece solid golf ball. At the same time as injection molding, dimples were formed in the cover surface in a combination as shown in Table 3. The resulting golf ball had a weight and an outer diameter as shown in Table 4.

The golf balls were examined for controllability, hitting feel and flight distance. Three professional golfers examined controllability and hitting feel by an actual hitting test. The flight distance (carry and total distance) was determined by actually hitting a ball by means of a swing robot at a head speed of 45 m/s.

Control

It was examined whether a ball was controlled as intended on iron shots (ease of hooking and slicing) and whether a ball stops short on the green. With respect to these two factors, the ball was totally evaluated. Ratings are "◎" for satisfactory, "O" for ordinary, and "X" for poor.

Hitting feel

A ball was actually hit with No. 1 wood and No. 5 iron to judge whether it was felt soft or hard. Dullness was evaluated in terms of subtle reaction upon hitting. The hard/soft feel was rated "◎" for a soft feel, "O" for ordinary, and "X" for a hard feel. The dull feel was rated "◎" for a click feel, "O" for ordinary, and "X" for a dull feel.

TABLE 1

| | | Core | | | | | | |
|---|---|---|---|---|---|---|---|---|
| | | E1 | E2 | E3 | CE1 | CE2 | CE3 | CE4 |
| Composition | Cis-1,4-polybutadiene | 100 | 100 | 100 | 100 | 100 | 100 | 100 |
| | Zinc acrylate | 26 | 23 | 30 | 20 | 35 | 30 | 23 |
| | Zinc oxide | 22 | 23 | 20 | 25 | 19 | 20 | 23 |
| | Dicumyl peroxide | 1 | 1 | 1 | 1 | 1 | 1 | 1 |
| | Peroxide* | 0.3 | 0.3 | 0.3 | 0.3 | 0.3 | 0.3 | 0.3 |
| Vulcanizing conditions | Temperature (°C.) | 160 | 160 | 160 | 120 | 120 | 160 | 160 |
| | Time (min.) | 20 | 20 | 20 | 80 | 80 | 20 | 20 |
| Distortion under 100 kg (mm) | | 3.4 | 3.8 | 2.9 | 4.1 | 2.0 | 2.9 | 3.8 |

*1,1-bis(t-butylperoxy)-3,3,5-trimethylcyclohexane (trade name: Perhexa 3M-40, Nihon Fats and Oils K.K.)

TABLE 2

| | | Cover | | | |
|---|---|---|---|---|---|
| | | A | B | C | D |
| Composition | Himilan 1557 | 50 | — | 50 | — |
| | Himilan 1601 | 50 | — | — | — |
| | Himilan 1605 | — | — | 50 | 50 |
| | Himilan 1855 | — | 50 | — | — |
| | Himilan 1856 | — | 50 | — | — |
| | Himilan 1706 | — | — | — | 50 |
| Hardness, JIS-C | | 83 | 81 | 86 | 93 |

Himilan is the trade name of ionomer resin commercially available from Mitsui-duPont Polychemical K.K.

TABLE 3

| | | Dimple | | | |
|---|---|---|---|---|---|
| Set | Dm (mm) | Dp (mm) | $V_0$ | Number | Dst |
| I | 4.000 | 0.210 | 0.500 | 72 | |
| | 3.850 | 0.200 | 0.500 | 200 | |
| | 3.400 | 0.180 | 0.500 | 120 | |
| | | | | total 392 | 4.540 |
| II | 3.800 | 0.210 | 0.480 | 162 | |
| | 3.600 | 0.210 | 0.480 | 86 | |
| | 3.450 | 0.210 | 0.480 | 162 | |
| | | | | total 410 | 4.265 |
| III | 3.300 | 0.195 | 0.390 | 360 | |
| | 2.500 | 0.195 | 0.390 | 140 | |
| | | | | total 500 | 2.060 |

Dm: dimple diameter, Dp: dimple depth, Number: number of dimples, $V_0$ and Dst: as defined above.

TABLE 4

| | | | Golf ball | | | | | | |
|---|---|---|---|---|---|---|---|---|---|
| | | | E1 | E2 | E3 | CE1 | CE2 | CE3 | CE4 |
| Core | Outer diameter (mm) | | 38.9 | 38.9 | 39.3 | 38.9 | 38.9 | 39.3 | 38.9 |
| | Hardness (JIS-C) | Center | 60 | 57 | 65 | 60 | 80 | 65 | 57 |
| | | 5 mm from the surface | 73 | 69 | 77 | 63 | 83 | 77 | 69 |
| | | Surface | 77 | 76 | 80 | 65 | 85 | 80 | 76 |
| | Distortion under 100 kg (mm) | | 3.4 | 3.8 | 2.9 | 4.1 | 2.0 | 2.9 | 3.8 |
| Cover | Type | | B | B | A | A | C | D | B |
| | Hardness (JIS-C) | | 81 | 81 | 83 | 83 | 86 | 93 | 81 |
| Ball | Outer diameter (mm) | | 42.7 | 42.7 | 42.7 | 42.7 | 42.7 | 42.7 | 42.7 |
| | Weight (g) | | 45.3 | 45.3 | 45.3 | 45.3 | 45.3 | 45.3 | 45.3 |
| Dimple set | | | I | II | I | I | II | I | III |
| Performance | Controllability | | ◎ | ◎ | ◎ | ◎ | ○ | X | ○ |
| | Hard/soft feel | | ◎ | ◎ | ◎ | ◎ | X | ○ | ◎ |
| | Dull feel | | ◎ | ◎ | ◎ | X | ○ | X | ◎ |
| | Carry (m) | | 215.3 | 215.0 | 215.8 | 208.5 | 213.5 | 214.0 | 211.6 |
| | Total (m) | | 232.6 | 232.0 | 233.0 | 228.0 | 231.0 | 231.5 | 227.5 |

Japanese Patent Application No. 71135/1996 is incorporated herein by reference.

Although some preferred embodiments have been described, many modifications and variations may be made thereto in the light of the above teachings. It is therefore to be understood that within the scope of the appended claims, the invention may be practiced otherwise than as specifically described.

We claim:

1. A two-piece solid golf ball comprising a solid core and a cover enclosing the core and having a number of dimples in its surface, wherein said solid core has such a distribution of hardness as measured by a JIS-C scale hardness meter that a surface hardness is up to 85 degrees, a center hardness is lower than the surface hardness by not less than 8 to less than 20 degrees, and a hardness within 5 mm inside the core surface is up to 8 degrees lower than the surface hardness, said cover has a hardness which is higher than the surface hardness of the core by 1 to 15 degrees and a gage of 1.5 to 1.95 mm, and the number of dimples is 360 to 450.

2. The two-piece solid golf ball of claim 1 wherein said solid core experiences a distortion of 2.8 to 4.0 mm under a load of 100 kg.

3. The two-piece solid golf ball of claim 1 wherein n types of dimples are formed in the cover surface wherein n≧2, the respective types of dimples having a diameter Dmk, a maximum depth Dpk, and a number Nk wherein k=1, 2, 3, . . . , n, and an index (Dst) of overall dimple surface area given by the following expression:

$$Dst = \frac{n \sum_{k-1}^{n} [(Dmk^2 + Dpk^2) x V_0 kx Nk]}{4R^2}$$

wherein R is a ball radius and $V_0$ is the volume of a dimple space below a plane circumscribed by the edge of a dimple divided by the volume of a cylinder whose bottom is the plane and whose height is the maximum depth of the dimple from the bottom is at least 4.0.

4. The two-piece solid golf ball of claim 1 wherein said cover has a hardness of 75 to 90 degrees as measured by a JIS-C scale hardness meter.

* * * * *